US005975685A

United States Patent [19]

Asaba et al.

[11] Patent Number: 5,975,685

[45] Date of Patent: Nov. 2, 1999

[54] INK JET RECORDING HEAD HAVING AN ORIENTED P-N JUNCTION DIODE, AND RECORDING APPARATUS USING THE HEAD

[75] Inventors: Tetsuo Asaba, Odawara; Shigeyuki Matsumoto, Atsugi; Hideshi Kuwabara, Zama, all of Japan

[73] Assignee: Canon Kabushiki Kaisha, Tokyo, Japan

[21] Appl. No.: 08/990,919

[22] Filed: Dec. 15, 1997

Related U.S. Application Data

[63] Continuation of application No. 08/365,237, Dec. 28, 1994, abandoned.

[30] Foreign Application Priority Data

Jun. 5, 1997 [JP] Japan ..... 9-163262

[51] Int. Cl.[6] ..... B41J 2/05

[52] U.S. Cl. ..... 347/59

[58] Field of Search ..... 347/50, 59; 438/45, 438/97, 365, 586, 330, 362, 148, DIG. 19; 257/518, 538, 537

[56] References Cited

U.S. PATENT DOCUMENTS

| | | | |
|---|---|---|---|
| 4,429,321 | 1/1984 | Matsumoto | 347/59 |
| 4,716,131 | 12/1987 | Okazawa et al. | 438/586 |
| 5,017,503 | 5/1991 | Shiba | 438/330 |
| 5,157,419 | 10/1992 | Matsumoto et al. | 347/59 |

FOREIGN PATENT DOCUMENTS

| | | |
|---|---|---|
| 2843064 | 4/1979 | Germany . |
| 54-51837 | 4/1979 | Japan . |
| 57-72867 | 5/1982 | Japan . |

*Primary Examiner*—N. Le
*Assistant Examiner*—L. Anderson
*Attorney, Agent, or Firm*—Fitzpatrick, Cella, Harper & Scinto

[57] ABSTRACT

An ink jet head provided with discharging orifices for discharging ink, which includes a substrate having a supporting member having at least a surface having substantially insulating properties and a plurality of diodes provided on the supporting member, the diodes each comprising a polycrystalline silicon layer and at least one metal silicide layer, wherein the polycrystalline silicon layer has a p-n junction surface therein.

32 Claims, 12 Drawing Sheets

INK JET RECORDING HEAD HAVING AN ORIENTED P-N JUNCTION DIODE, AND RECORDING APPARATUS USING THE HEAD

CROSS-REFERENCE TO RELATED APPLICATION

This application is a continuation of application Ser. No. 08/365,237, filed on Dec. 28, 1994, now abandoned.

BACKGROUND OF THE INVENTION

1. Field of the Invention

The present invention relates to an ink jet head in which part of drive circuits are incorporated, a substrate for the head, and an apparatus provided with the head. In the specification and claims, "recording" includes ink application etc. (printing) onto any ink supporting member to which ink is to be applied, such as fabric, thread, paper, sheet medium, etc., and "recording apparatus" includes all types of information processing apparatus and printers as an output device thereof. Therefore, the present invention can be applicable to applications in these fields.

2. Related Background Art

An example of a recording head unit in an apparatus applied to the liquid jet recording method, as described in Japanese Laid-open Patent Application No. 54-51837, German Laid-open Patent Application (DOLS) No. 2843064, etc., is provided with orifices (discharging openings) arranged to discharge a liquid (ink); liquid discharging portions communicating with the respective orifices and having respective liquid paths (channels) each comprising as a part of structure a thermal action portion in which thermal energy to be utilized for discharging the liquid in the form of drop acts on the liquid; and electrothermal converters as means for generating the thermal energy.

An electrothermal converter has a pair of electrodes and a heating resistor layer connected to the electrodes and having a heating region (heat generating portion) between the electrodes. The pair of electrodes are generally composed of a select electrode and a common electrode in such an arrangement that with current supply between the electrodes the heat generating portion generates the thermal energy utilized for discharging the liquid through an orifice as described above.

The conventional recording heads were constructed in such an arrangement that an array of electrothermal converters were formed on a monocrystal silicon base while functional devices for driving the electrothermal converters, for example an array of transistors, were provided as drive circuits for the electrothermal converters outside the silicon base and that flexible cables or wire bonding etc. was used for connection between the electrothermal converters and the transistor array.

In order to simplify the structure considered for the above head arrangement, to reduce defects produced in fabrication steps, to make performance of devices consistent, and to improve reproducibility, there is a known ink jet recording apparatus having a recording head in such an arrangement that electrothermal converters and functional devices are provided on a same base, as described in Japanese Laid-open Patent Application No. 57-72867 corresponding to U.S. Pat. No. 4,429,321.

FIG. 1 is a cross-sectional view to show a part of a substrate for recording head in the above arrangement. Reference numeral 301 designates a * semiconductor supporting member of monocrystalline silicon. Further, 302 denotes an epitaxial region of n-type semiconductor, 314 an ohmic contact region of n-type semiconductor of high impurity concentration, 313 a base region of p-type semiconductor, and 305 an emitter region of n-type semiconductor of high impurity concentration, thereby forming a bipolar transistor 315. In addition, 306, 308 are silicon oxide layers as a heat storage layer and an interlayer insulating layer, 310 a heat resistor layer, 309 a wiring electrode of aluminum (Al), and 311 a silicon oxide layer as a protective layer, thereby forming a substrate 316 for recording head. Here, the heat resistor layer 310 becomes a heating portion. Then liquid paths (channels) are formed on this substrate 316 so as to construct a recording head.

Such an ink jet recording head, particularly an ink jet recording head utilizing foaming of ink with heating of heater, uses p-n junction diodes, bipolar transistors, or MOS transistors for switching of current. These semiconductor devices are normally made of monocrystalline silicon.

FIGS. 2A to 2C are drawings to show a p-n junction diode of monocrystalline silicon in a conventional example, wherein FIG. 2A is a cross section and FIGS. 2B and 2C are equivalent circuit diagrams. In FIGS. 2A to 2C, an aluminum wire 2*a* shorts the circuit between the base and the collector of bipolar transistor, whereby the transistor operates as a p-n junction diode. The reason why the bipolar transistor is used as a p-n junction diode is to prevent interference between adjacent transistors by device isolation, thereby preventing latchup. Also, a drive current can be set high by transistor operation.

The above conventional examples, however, had the following two drawbacks because p-n isolation was employed for electrical isolation of diodes.

(1) A parasitic bipolar transistor is formed among the base portion 313 and collector portions 303, 304 of diode, and the supporting members 301, 302. In order to stop a current flowing into the supporting members 301, 302, the collector portions 303, 304 of diode, i.e., the base portion of the parasitic bipolar transistor needs to be a high concentration layer. Thus, a spread in length and width of the diffusion layers 303, 304 becomes larger, which is a factor to obstruct miniaturization of diode.

(2) Since the base region 313 needs to be three-dimensionally junction-isolated, existence of the buried layer 303 becomes essential, so that the fabrication steps must include epitaxial growth. The epitaxial growth step becomes a factor to considerably raise the production costs in fabricating cheap ink jet heads, resulting in increasing the costs of manufacture.

Plainly speaking, the above conventional examples had the following problems because they used monocrystalline silicon.

(1) The supporting member used is expensive.

(2) A high-temperature process is required.

(3) A large device isolation region is necessary.

(4) Device performance becomes over specifications.

SUMMARY OF THE INVENTION

Under the above circumstances, an object of the present invention is to provide an ink jet head which can obviate the effect of parasitic bipolar transistor when drive circuits are incorporated in the head and which necessitates no buried layer in a monocrystalline supporting member, and to provide a substrate for the head and an apparatus provided with the head.

Another object of the present invention is to provide an ink jet head provided with discharging orifices for discharging ink, which comprise a substrate comprising a supporting member comprising at least a surface having substantially insulating properties, and a plurality of diodes provided on said supporting member, said diodes each comprising a polycrystalline silicon layer and at least one metal silicide layer, wherein said polycrystalline silicon layer has a p-n junction surface therein.

Still another object of the present invention is to provide a substrate for ink jet head comprising a supporting member at least a surface of which has substantially insulating properties and a plurality of diodes provided on said supporting member, said diodes each comprising a polycrystalline silicon layer and at least one metal silicide layer, wherein said polycrystalline silicon layer has a p-n junction surface therein.

Still another object of the present invention is to provide an ink jet apparatus comprising the ink jet head as described above, wherein said ink jet head is detachably mounted on a main body of the apparatus.

Still another object of the present invention is to provide an ink jet recording means wherein switching is effected by a polycrystalline silicon p-n junction diode formed on an insulating supporting member.

In the present invention, the array of diodes of polycrystalline silicon are formed on the supporting member at least a surface of which has substantially insulating properties, so that isolation between diodes is not the p-n isolation but dielectric isolation, thereby fundamentally preventing constitution of parasitic bipolar transistor.

In the present invention the plurality of diodes of polycrystalline silicon are formed on the supporting member at least a surface of which has substantially insulating properties, whereby the effect of parasitic bipolar transistor can be perfectly eliminated, thus keeping no excessive current flowing into the base.

The conventional examples necessitated at least five or six photolithography steps and an epitaxial growth step before wiring of aluminum, whereas the present invention requires four photolithography steps and no epitaxial growth step because of no need of buried layer in a monocrystalline supporting member, thereby enabling a 30 or more percent cut in fabrication costs.

Since there is no need of existence of a silicon supporting member below the heater, a quartz supporting member low in thermal conductivity can be used instead.

Further, the present invention permits an impurity to be introduced in a low-temperature process, and can realize an ink jet head using a cheap diode array with necessary and sufficient device performance and with small device isolation regions, and a substrate for the head and an ink jet apparatus provided with the head.

The present invention as described has the following effects by the arrangement that the p-n junction diodes of polycrystalline silicon are formed on the insulating layer.

(1) No epitaxial growth layer is necessary.

(2) Diffusion of impurity, and ion implantation are not always necessary.

(3) A cheap glass supporting member can be used.

(4) The impurity can be introduced in a low-temperature process.

(5) No high-temperature drive is necessary.

(6) The device isolation regions can be decreased whereby the degree of integration of all devices can be increased. These show considerable effects for reducing the production costs.

Characteristics required for diodes for ink jet recording head are 35 V of reverse withstand voltage, 200 mA of forward current, and 600 or less $\mu$A of reverse current (current ratio$\simeq 3\times10^3$), which can be readily realized by forming the diodes not of monocrystal silicon but of polycrystalline silicon.

The above arrangement can realize an ink jet head using a cheap diode array with necessary and sufficient device performance and with small device isolation regions, and a substrate for the head and an ink jet apparatus provided with the head.

DETAILED DESCRIPTION OF THE PREFERRED EMBODIMENTS

The embodiments of the present invention will be described in detail with reference to the accompanying drawings.

Figure 3:
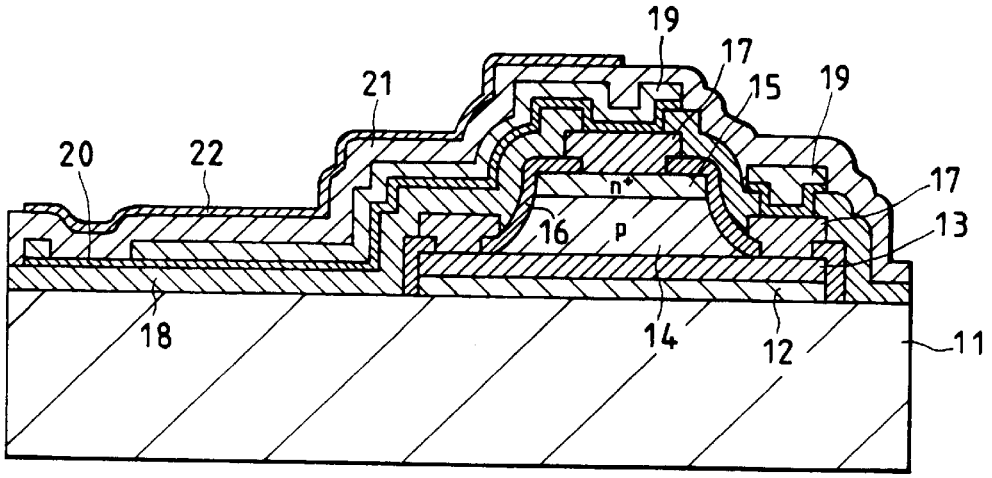
FIG. 3 is a cross-sectional view to show structure of a substrate for ink jet head according to an embodiment of the present invention.
Figure 2A:
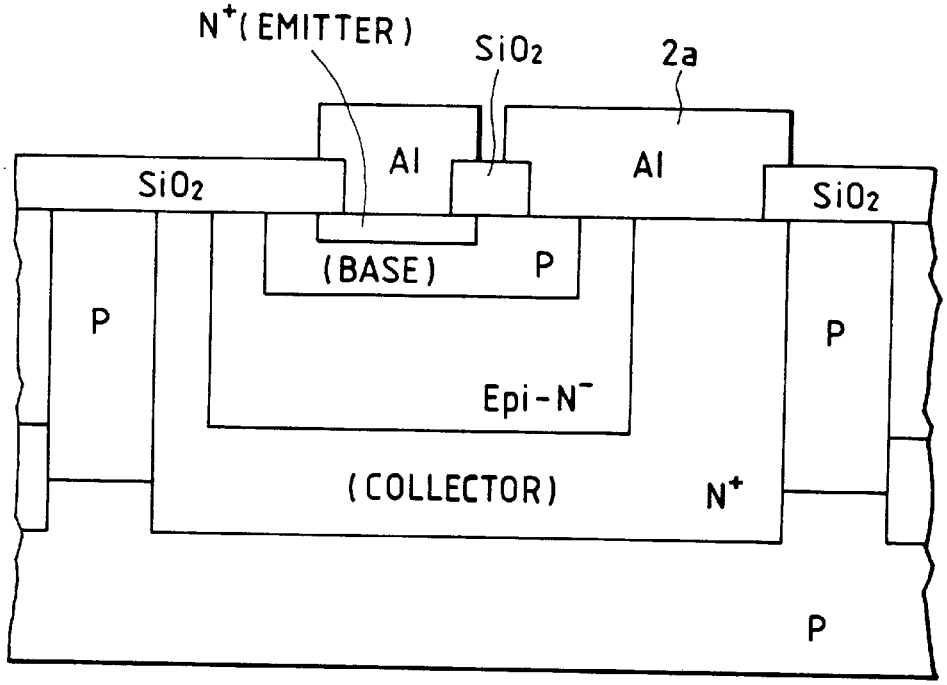
PRIOR ART FIG. 2A
FIGS. 2A to 2C are schematic views to show a p-n junction diode of monocrystalline silicon in a substrate for ink jet head according to a conventional example.
Figure 2B:
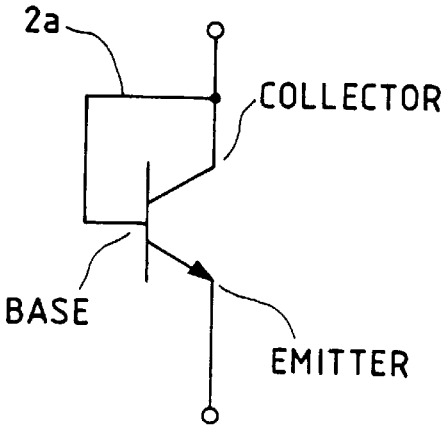
PRIOR ART FIG. 2B
Figure 2C:
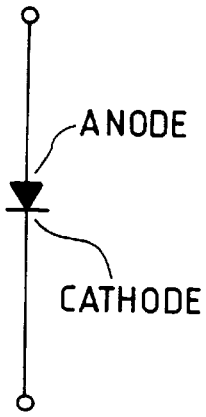
PRIOR ART FIG. 2C

FIG. 3 is a structural, cross-sectional view to show features of a substrate for ink jet head in an embodiment of the present invention best. In FIG. 3, reference numeral 11 designates a supporting member made of quartz or constructed in such an arrangement that an insulating member such as a silicon oxide layer or the like is formed on a silicon wafer, 12 a pad material for example of polycrystalline silicon (hereinafter also referred to as "polysilicon") etc., 13 a metal silicide layer for example of tungsten silicide or the like, 14 a polycrystalline silicon layer having p-type or n-type conductivity, 15 a dense diffusion layer formed by diffusing an impurity in the polycrystalline silicon layer 14 so as to have the opposite conductivity, 16 a silicon thermal-oxidation layer, 17 a first wiring layer made of a metal such as aluminum etc., 18 an interlayer insulating layer for example of silicon dioxide etc., 19 a second wiring layer made of a metal such as aluminum etc., 20 a heater material for example of tantalum nitride etc., 21 a passivation film made for example of silicon nitride etc., and 22 a cavitation prevention layer made for example of tantalum etc.

Next described in detail with the drawings is an example of fabrication of the substrate for ink jet head in an embodiment according to the present invention.

FIGS. 4A to 4E are cross-sectional views to show steps in an embodiment according to the present invention.

First, polycrystalline silicon 32 is deposited in the thickness of 1500 Å on a circular supporting member 31 of a diameter of 150 mm by low-pressure CVD. Next, a tungsten silicide layer 33 is deposited in the thickness of 2500 Å similarly over the entire surface by sputtering with an eutectic target. Then the silicide layer 33 is sintered to harden at a temperature of 1050° C. in a nitrogen atmosphere for 30 minutes in order to avoid surface defects in the following steps. Next, polycrystalline silicon 34 is again deposited in the thickness of about 3 $\mu$m by low-pressure CVD. The thickness of the polycrystalline silicon 34 becomes an important parameter concerning the reverse withstand voltage of diode.

For example, when a low-concentration diffusion layer is of the p-type and the concentration is $2\times10^{16}/cm^3$, a thickness of not less than 2 $\mu$m is necessary in order to avoid punch-through up to 35V.

After completion of deposition of polycrystalline silicon 34, ion implantation of boron is carried out. A dose of boron is $6\times10^{12}$ ions/cm$^2$ and an acceleration voltage is 120 keV.

Figure 4A:
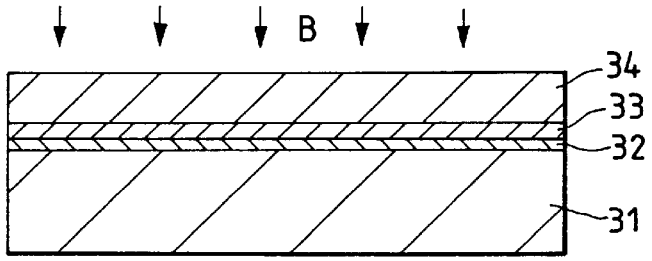
FIGS. 4A to 4E are cross-sectional views to show an example of fabrication steps of a substrate for ink jet head of the present invention.

After the ion implantation, a drive is conducted at 1100° C. for 120 minutes (FIG. 4A).

Figure 4B:
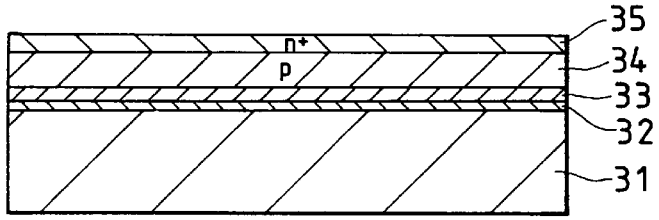

Next, using phosphorus oxychloride ($POCl_3$), phosphorus glass is deposited on the polycrystalline silicon 34 and then a drive is carried out at 950° C. for 10 minutes to form a dense n-type diffusion layer 35 (FIG. 4B).

Figure 4C:
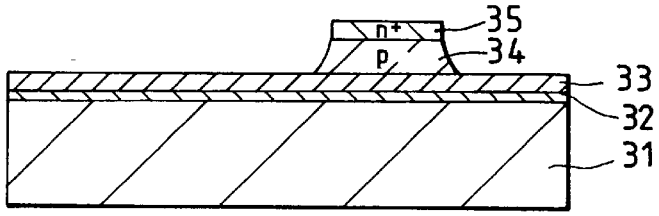

Subsequently, a photoresist pattern is formed at a predetermined position corresponding to the n-region by the photolithography process. After formation of the photoresist pattern, the polycrystalline silicon layers 34, 35 are etched by microwave dry etching with a mixture gas of $CF_4$, oxygen and nitrogen. Although dry etching with parallel plates can be employed, isotropic etching is rather preferable in order to facilitate photolithography works in the subsequent steps. It is rather difficult to control etch selectivity to the below tungsten silicide layer 33, but no problem will occur even if it is etched by about 1000 Å (FIG. 4C).

Figure 4D:
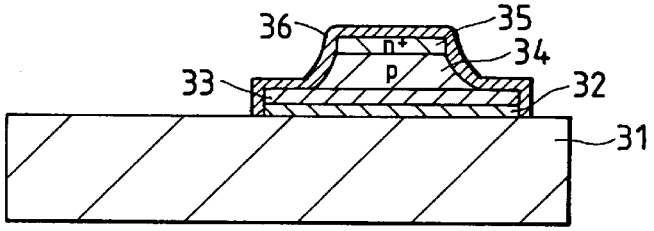

Next, to obtain a contact with the p-type region, an oversize photoresist pattern is formed at a predetermined position over the n-region. After formation of the photoresist pattern, the tungsten silicide layer 33 and the polycrystalline silicon layer 32 are etched by microwave dry etching using the above gas system, i.e., the mixture gas of $CF_4$, oxygen and nitrogen. This etching may be either anisotropic or isotropic. After this etching, a silicon thermal oxidation layer 36 is grown in the thickness of 2200 Å by pyro oxidation. Existence of the lower polycrystalline silicon layer 32 is important in order to grow the silicon thermal oxidation layer on the tungsten silicide layer 33 (FIG. 4D).

Figure 4E:
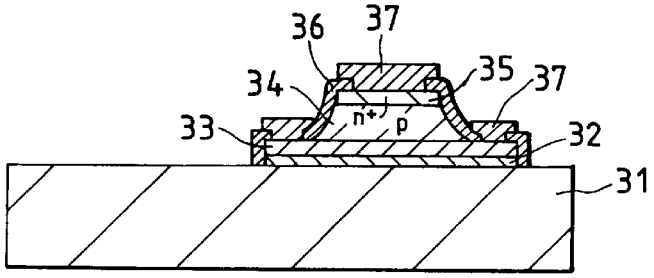

Next, contact holes are formed through the thermal oxidation layer 36 by photolithography. This etching is conducted by wet etching with buffered hydrofluoric acid. Then aluminum 37 is deposited in the thickness of about 8000 Å by sputtering and then processed in a predetermined pattern by photolithography. This etching is conducted by wet etching with a phosphoric acid-nitric acid system (FIG. 4E).

Subsequently, a heater array is formed according to the conventional method to obtain the final form as shown in FIG. 3. Since a junction surface of polycrystalline silicon is used, a saturation current of diode naturally becomes large. For example, upon application of 20 V in the reverse direction, a current value becomes 8 mA/cm$^2$. When an area of the junction of diode is 300 $\mu$m square, a leakage current is 8 $\mu$A, so that breaking characteristics are of a level fully acceptable for practical use.

Figure 5:
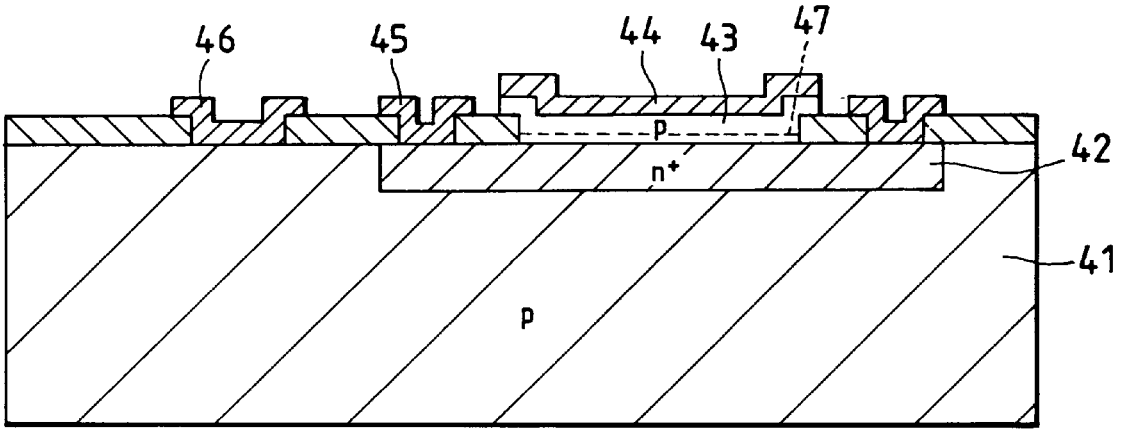
FIG. 5 is a cross-sectional view to show structure of a substrate for ink jet head according to another embodiment of the present invention.

The above embodiment is arranged in such structure that no parasitic bipolar transistor is formed at all, but in order to reduce deference between devices, another embodiment may be a diode having the structure shown in FIG. 5. Numeral 41 designates a silicon monocrystal support member of p-type, 42 a dense n-type diffusion layer, 43 a p-type polycrystalline silicon layer, 44 a tungsten silicide layer, 45 an electrode of n-type region, and 46 an electrode for dropping a potential of substrate to the ground.

It seems in the case of the above structure that a parasitic p-n-p transistor is formed with the p-type silicon supporting member 41 as a collector, but a current flowing into the supporting member 41 becomes not more than 1 $\mu$A insofar as the concentration of the $n^+$ layer as a base is not less than $1\times10^{19}$, causing no trouble in practical applications. Namely, the supporting member 41 has a structure in which at least a surface thereof has substantially insulating properties. Here, the tungsten silicide layer 44 on the p-type polycrystalline silicon 43 is given for preventing a drop of withstand voltage due to spike of aluminum.

In order to make the resistance of the above tungsten silicide layer 44 low, a heat treatment of about 1000° C. is normally carried out in an inert gas by ordinary technology. During this heat treatment, the n-type impurity diffuses in about 0.5 $\mu$m from the n-type diffusion layer 42 in the monocrystalline supporting member to the p-type polycrystalline silicon layer 43 because of a concentration difference. Therefore, the p-n junction surface is formed not at an interface between the monocrystalline supporting member 41, 42 and the polycrystalline silicon layer 43, but in the polycrystalline silicon layer 43 (as shown by 47 in FIG. 5).

Consequently, diode characteristics such as the reverse saturation current of diode can be considered as similar to those in the first embodiment.

Figure 6A:
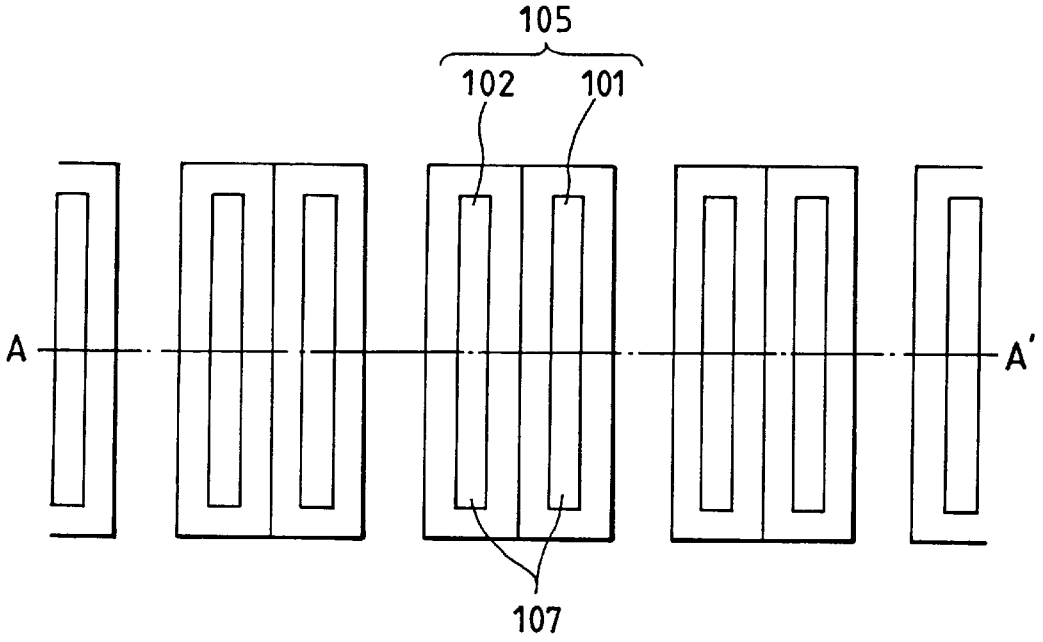
FIGS. 6A to 6C are schematic views to show polysilicon p-n junction diodes in a third embodiment of the present invention.
Figure 6B:
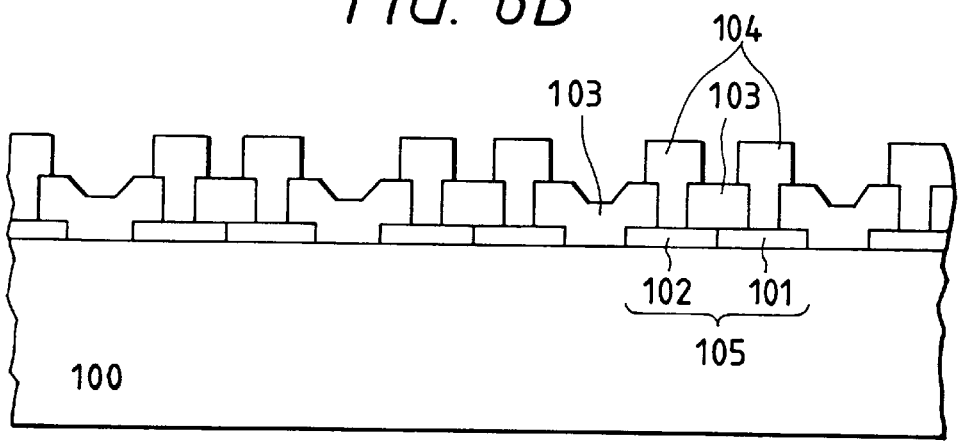
Figure 6C:
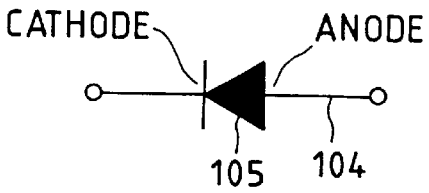

FIGS. 6A to 6C are schematic views to show polysilicon p-n junction diodes in a third embodiment of the present invention, wherein FIG. 6A is a plan view, FIG. 6B a cross section taken along A—A', and FIG. 6C an equivalent circuit diagram. In the drawings, a pair of p-type polysilicon 101 and n-type polysilicon 102 adjacent to each other is arranged on an insulating supporting member 100. Plural sets of p-type polysilicon 101 and n-type polysilicon 102 are provided so as to extend in the direction perpendicular to the p-n junction surface. The p-n junction surface is perpendicular to the surface of the insulating supporting member 100. A CVD insulating layer 103 is constructed in a structure for insulation between the sets of p-type polysilicon 101 and n-type polysilicon 102. An aluminum wire 104 is formed on each of the p-type polysilicon 101 and n-type polysilicon 102. The CVD insulating layer 103 also functions to give insulation between the aluminum wire 104 on the p-type polysilicon 101 and the aluminum wire 104 on the n-type polysilicon 102, that is, between the paired p-typed polysilicon 101 and n-type polysilicon 102. In the plan view of FIG. 6A the CVD insulating layer 103 and aluminum wires 104 are omitted to describe only contact holes 107. Thus, each set of p-type polysilicon 101 and n-type polysilicon 102 forms a polysilicon p-n junction diode 105.

Figure 7A:
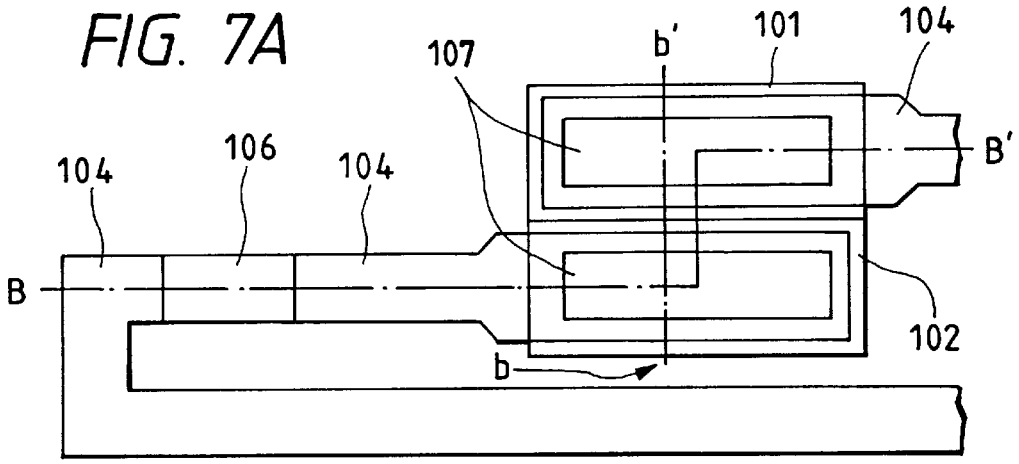
FIGS. 7A to 7D are schematic views to show a heater in the substrate for ink jet head, which is formed using the diode shown in FIGS. 6A to 6C.
Figure 7B:
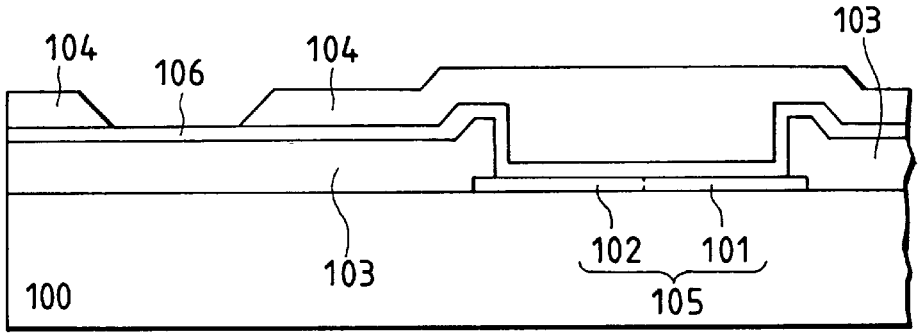
Figure 7C:
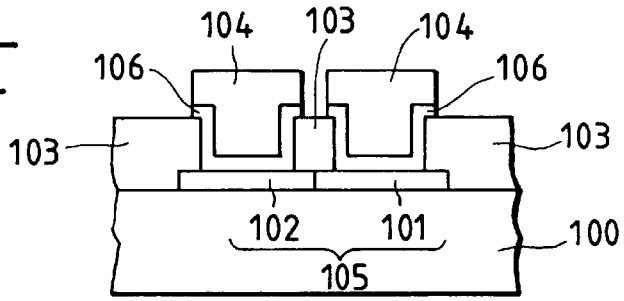
Figure 7D:
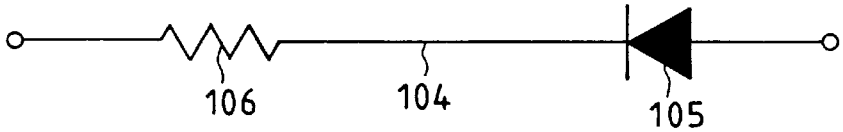

FIGS. 7A to 7D are schematic views to show a heater in a substrate for ink jet head formed as in FIGS. 6A to 6C, wherein FIG. 7A is a plan view, FIG. 7B a cross section along B—B', FIG. 7C a cross section along b—b', and FIG. 7D an equivalent circuit diagram. In FIGS. 7A to 7D, a heating member 106 becoming a heater extends between the CVD insulating layer 103 and the aluminum wire 104. When the polysilicon p-n junction diode 105 formed of p-type polysilicon 101 and n-type polysilicon 102 is biased in the forward direction, a current flows through the heating member 106. At this time the heating member 106 becomes a resistor as shown in FIG. 7D.

Figure 8:
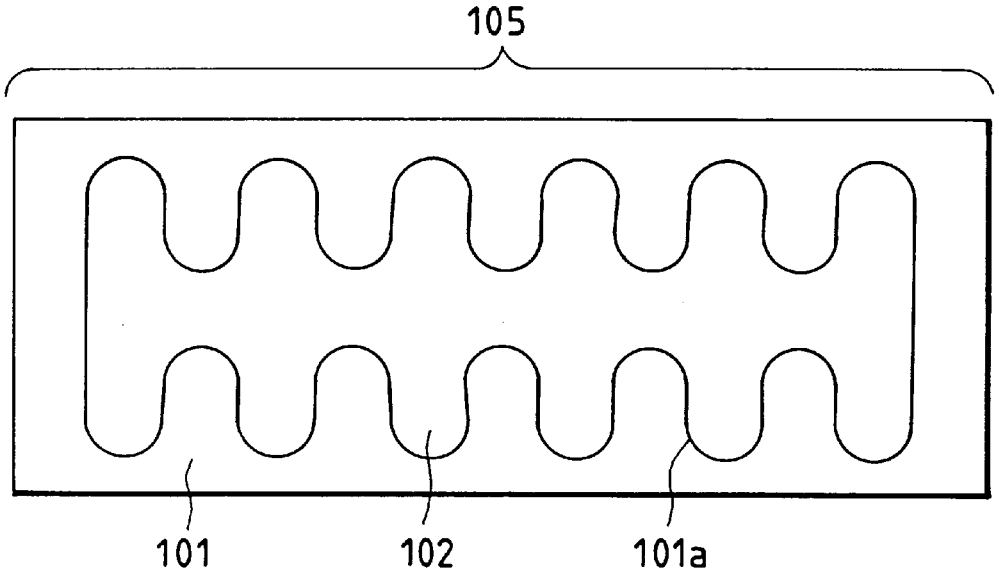
FIG. 8 is a plan view to show a polysilicon p-n junction diode in a fourth embodiment of the present invention.

FIG. 8 is a plan view to show a polysilicon p-n junction diode in a fourth embodiment of the present invention. In FIG. 8, the CVD insulating layer, aluminum wire, and contact holes are omitted. As shown in FIG. 8, the p-type polysilicon 101 surrounds the n-type polysilicon 102, and the p-n junction surface is a curved surface in a folded structure whereby an area of p-n junction can be made greater relative to the device area than that in the third embodiment. As a result, a greater current can be rectified. Although FIG. 8 shows an example in which the p-type polysilicon 101 surrounds the n-type polysilicon 102, another arrangement in which the n-type polysilicon 102 surrounds the p-type polysilicon 101 can also make the p-n junction area relative to the device area greater than that in the third embodiment, enabling to rectify a larger current.

Figure 9A:
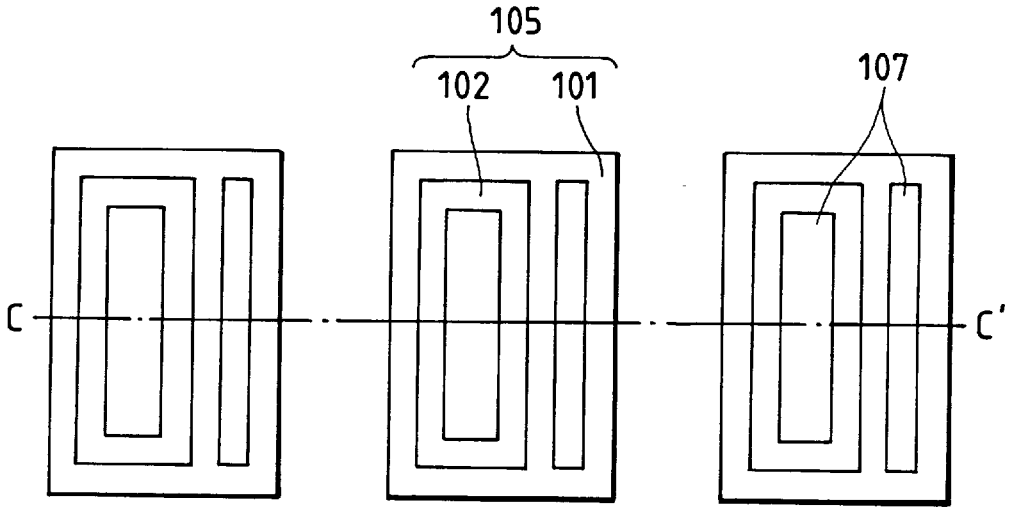
FIGS. 9A to 9C are schematic views to show polysilicon p-n junction diodes in a fifth embodiment of the present invention.
Figure 9B:
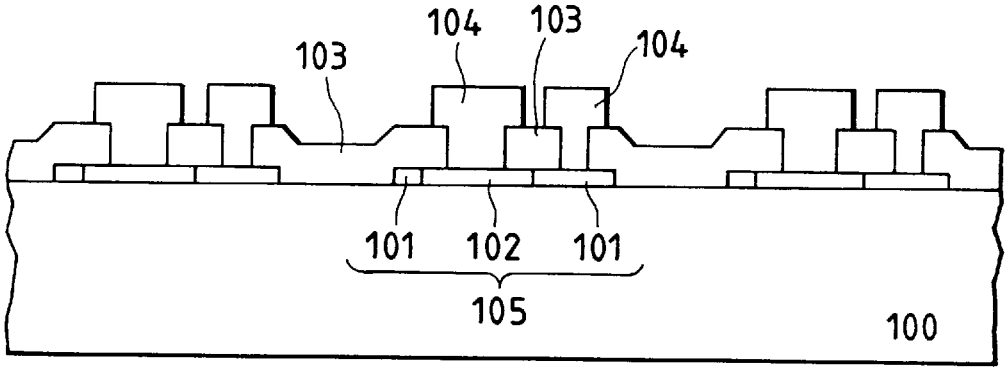
Figure 9C:
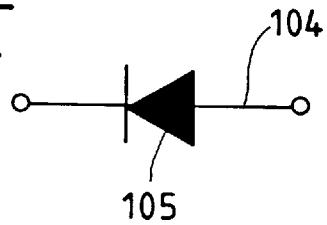

FIGS. 9A to 9C are schematic views to show polysilicon p-n junction diodes in a fifth embodiment of the present invention, wherein FIG. 9A is a plan view, FIG. 9B a cross section along C—C', and FIG. 9C an equivalent circuit diagram. In FIG. 9A, the CVD insulating layer 103 and aluminum wires 104 are omitted as in FIG. 6A and thus only contact holes 107 are shown. As shown in FIGS. 9A to 9C, the p-type polysilicon 101 surrounds the n-type polysilicon 102 so as to form an island of n-type polysilicon 102, whereby the p-n junction area relative to the device area can be set greater than that in the third embodiment. As a result, a greater current can be rectified. Although the example in FIGS. 9A to 9C is so arranged that the p-type polysilicon 101 surrounds the n-type polysilicon 102 so as to form the island of n-type polysilicon 102, an alternative arrangement may be such that the n-type polysilicon 102 surrounds the p-type polysilicon 101 so as to form an island of p-type polysilicon 101, whereby the p-n junction area relative to the device area can be made similarly greater than that in the third embodiment, enabling to rectify a larger current.

Figure 10:
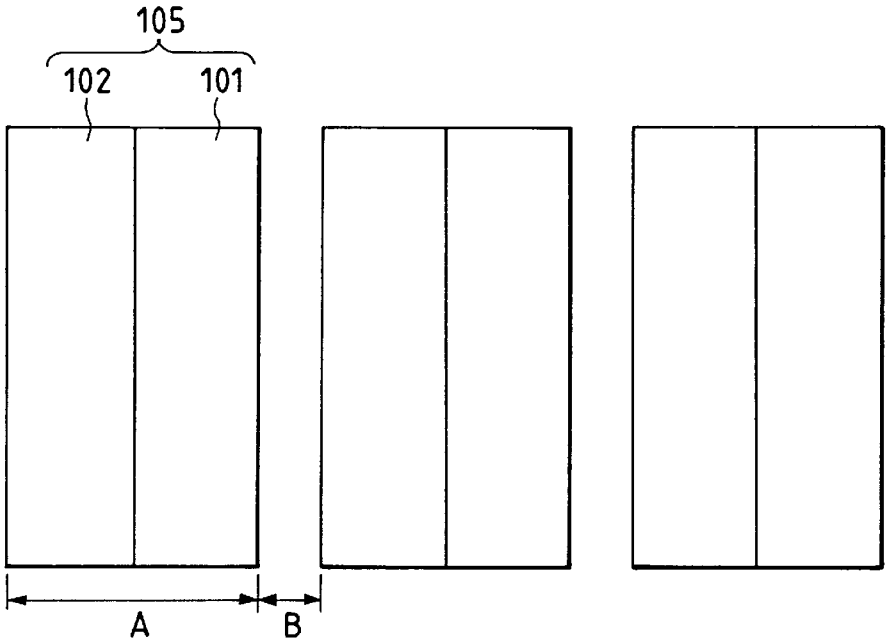
FIG. 10 is a plan view to show a relation between a polysilicon p-n junction diode and a device isolation region in a sixth embodiment of the present invention.

FIG. 10 is a plan view to show a relation between a polysilicon p-n junction diode and a device isolation area in a sixth embodiment of the present invention. In FIG. 10, the CVD insulating layer, aluminum wires, and contact holes are omitted. Further, only a plan view is shown in FIG. 10, but a cross section and an equivalent circuit diagram are the same as those in FIGS. 6B to 6C. As shown in FIG. 10, a length A in the direction perpendicular to the p-n junction surface, of the polysilicon p-n junction diode 105 is longer than a length B of the device isolation area that is a distance in the direction perpendicular to the p-n junction surface between two adjacent polysilicon p-n junction diodes 105 (i.e., A>B). In the present invention, because the polysilicon p-n junction diode 105 is formed on the insulating supporting member 100, no current flows in the insulating supporting member 100. Accordingly, the length B of the device isolation area is determined depending only on a withstand voltage of the CVD insulating layer 103 between adjacent polysilicon p-n junction diodes 105. Actually, the withstand voltage of the CVD insulating layer 103 is determined by patterning accuracy. Thus, the degree of integration of all devices can be increased by decreasing the device isolation area not affecting the operation of polysilicon p-n junction diodes 105.

Figure 1:
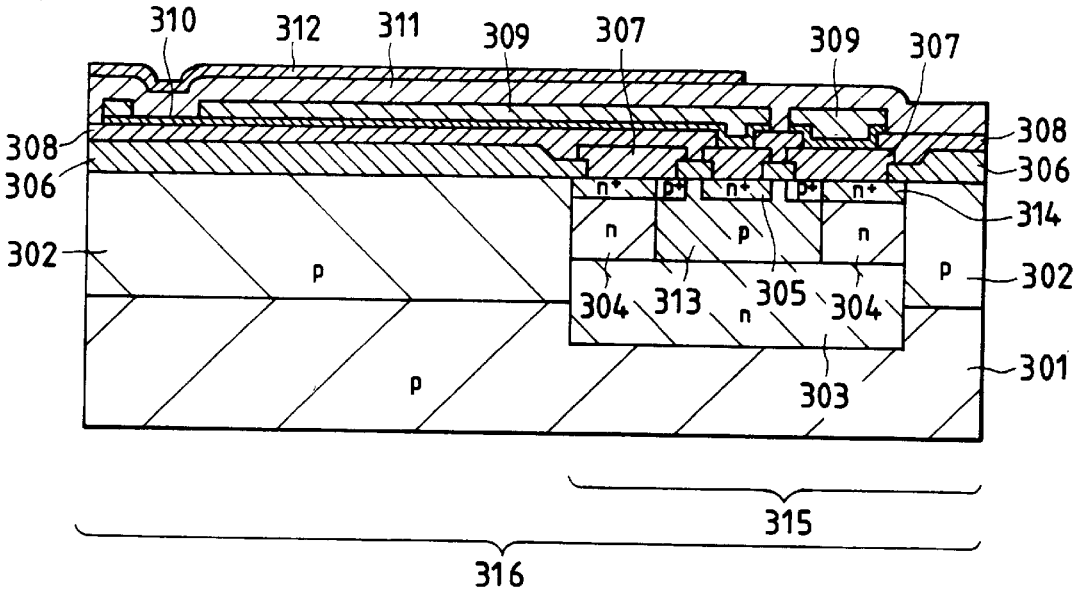
PRIOR ART FIG. 1
FIG. 1 is a schematic, cross-sectional view to show structure of a substrate for ink jet head according to a conventional example.
Figure 11A:
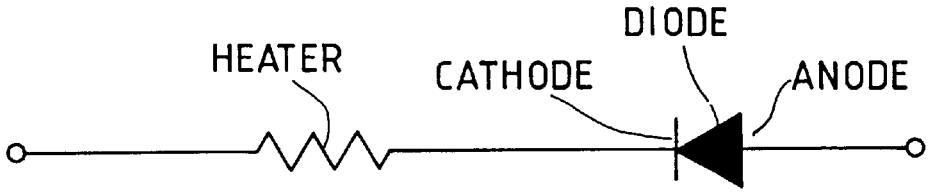
FIGS. 11A to 11C are schematic views to show equivalent circuits of current switching in respective embodiments of the present invention.
Figure 11B:
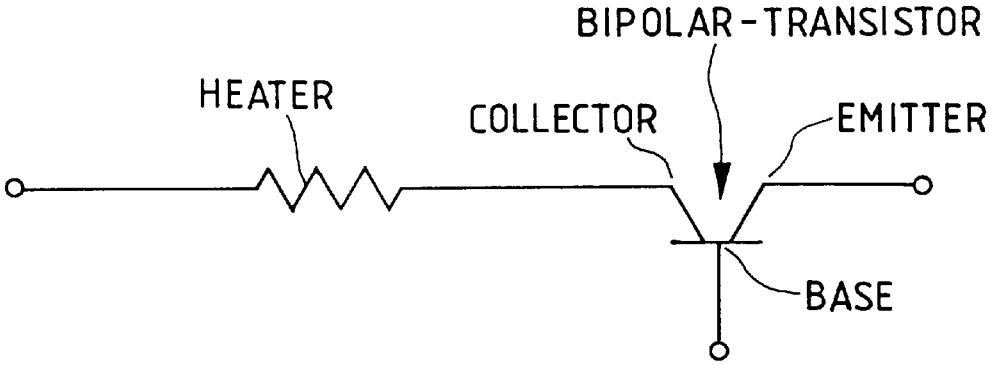
Figure 11C:
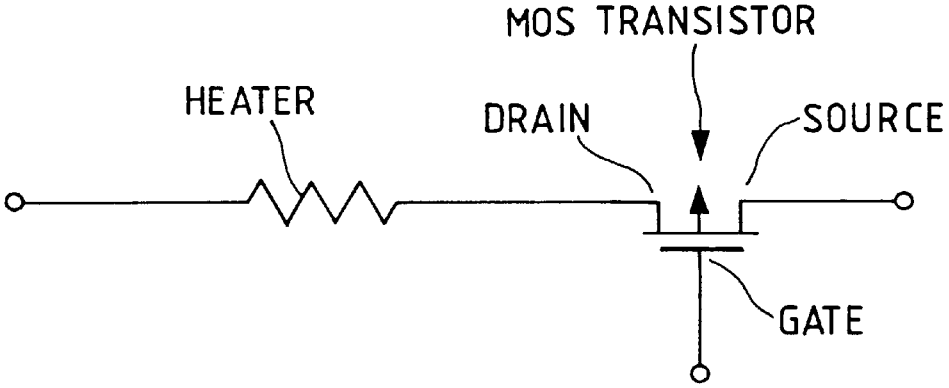

FIGS. 11A to 11C are schematic views to show equivalent circuits of current switching in respective embodiments of the present invention, wherein FIG. 11A shows a switching circuit using a diode, FIG. 11B a switching circuit using a bipolar transistor, and FIG. 11C a switching circuit using a MOS transistor. The above embodiments of the present invention showed examples using the diode as shown in FIG. 11A, whereas, as shown in FIG. 11B or FIG. 1C, a current switching circuit can be achieved using a bipolar transistor or a MOS transistor.

The insulating supporting member as described in the above embodiments of the present invention is a supporting member of oxidized silicon wafer or glass. The polysilicon p-n junction diode employed is so arranged that the thickness of polysilicon is in a range of 500 to 2000 Å and the p-n junction area is in a range of $1\times10^2$ to $1\times10^3$ $\mu m^2$.

Figure 12:
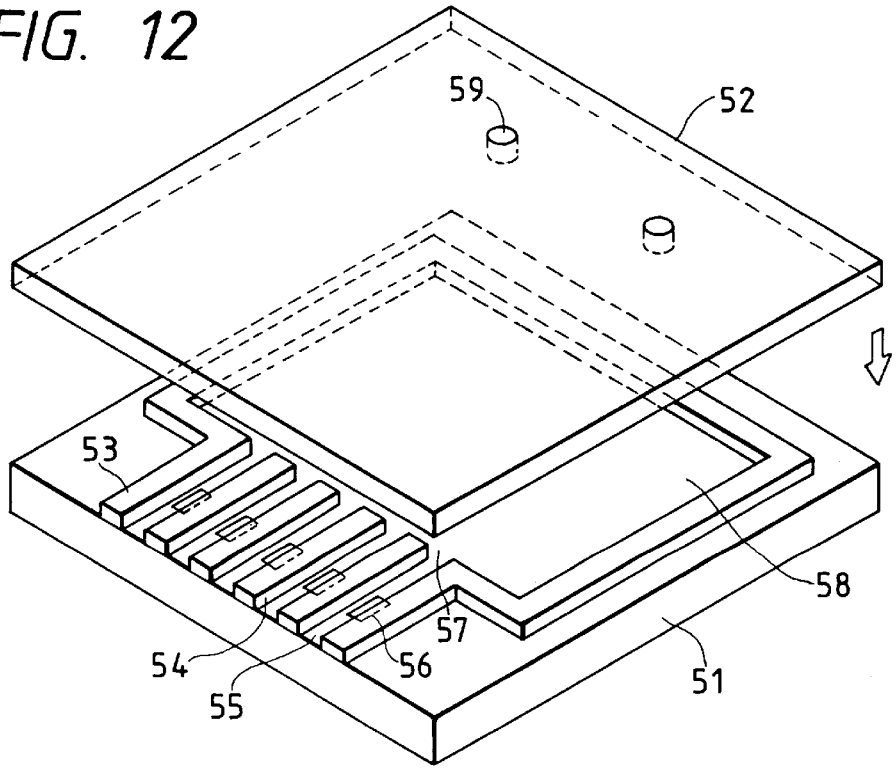
FIG. 12 is a perspective view to show structure of an example of an ink jet head according to the present invention.

FIG. 12 shows an example of structure of an ink jet head using the substrate having the above structure. As shown in the drawing, ink channels 54 are defined by a substrate 51, a top plate 52, and sidewalls 53 arranged at predetermined intervals between the substrate 51 and top plate 52 so as to communicate with respective discharging orifices 55 for discharging ink. On the substrate 51 near the discharging orifices 55 of the ink channels 54 are set heating portions 56 of electrothermal converters for generating the thermal energy to be utilized for forming a bubble in ink to discharge ink, and drive devices for driving the heating portions 56. Here, the drive devices have the above-described structure. Further, a common liquid chamber 58 communicating with the ink channels 54 through respective inlet openings 57 is defined by a sidewall 53 between the substrate 51 and top plate 52, and a supply opening 59 for supplying ink into the common liquid chamber 58 is formed in the top plate 52.

Figure 13:
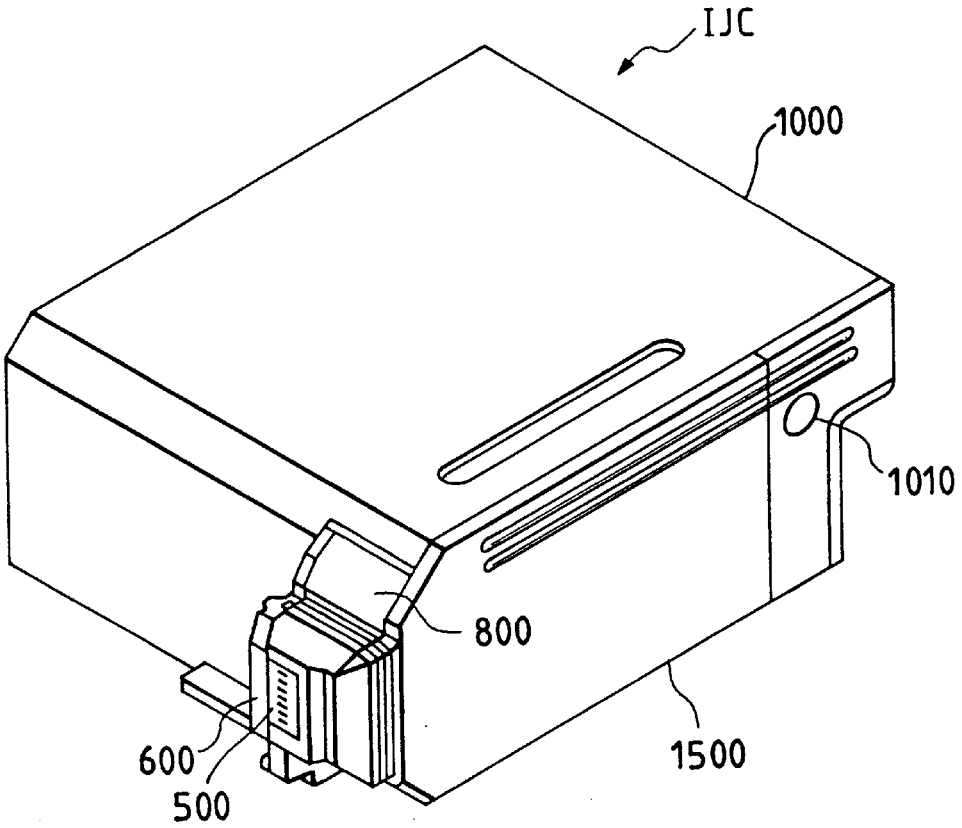
FIG. 13 is a perspective view to show an example of an ink jet cartridge using the ink jet head of the present invention.
Figure 14:
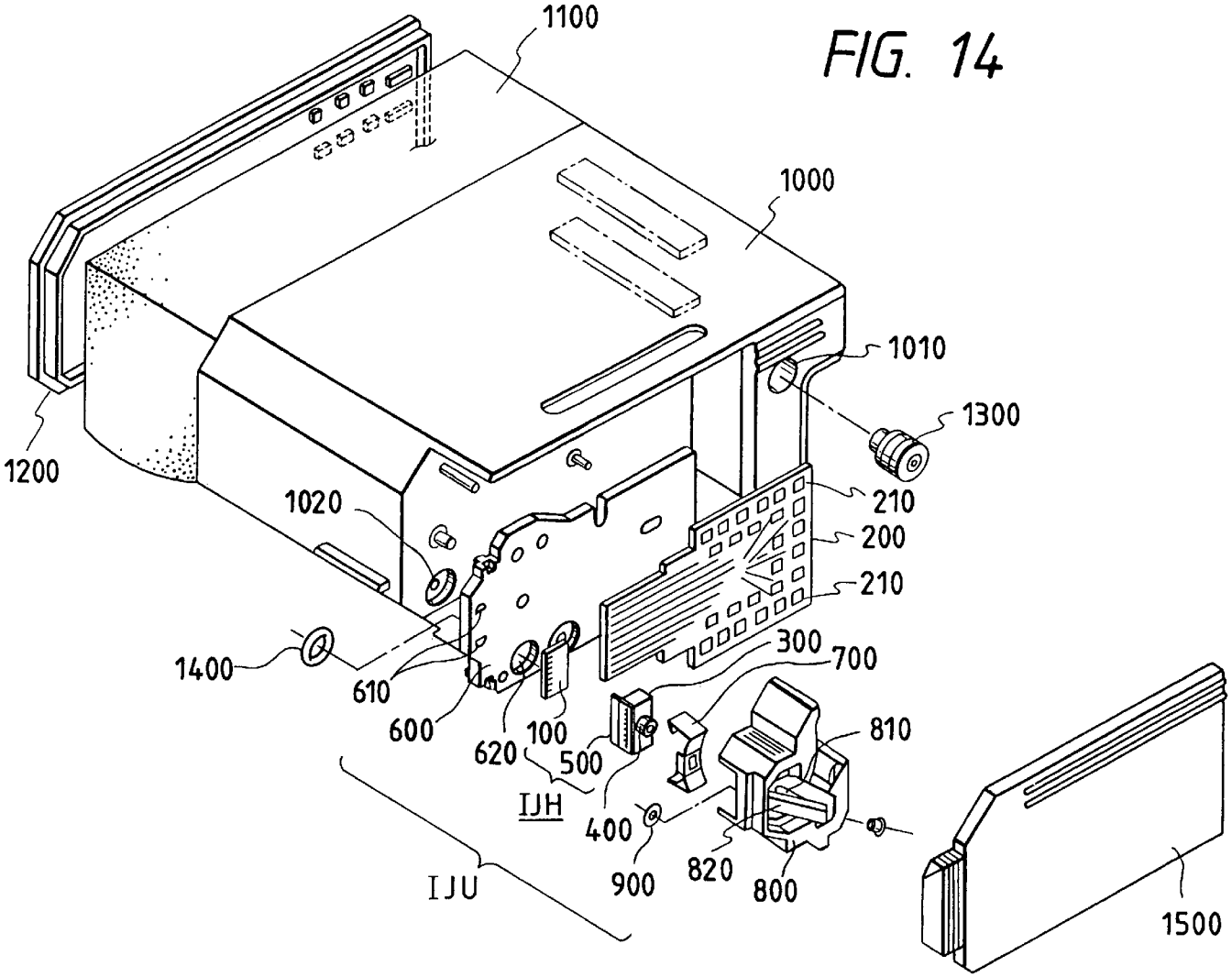
FIG. 14 is an exploded, perspective view of the ink jet cartridge of FIG. 13.

FIG. 13 is a perspective view of an ink jet cartridge IJC to which the ink jet head of the above structure is applied, and FIG. 14 is an exploded, perspective view thereof. In these drawings, 100 designates a heater board in which there are electrothermal converters arranged in a plurality of lines on a Si supporting member, drive devices for driving the electrothermal converters, and electrical wires for example of Al for supplying power, as formed by the film-forming technology, and 200 a wiring substrate for the heater board 100. The wiring substrate 200 has wires corresponding to those in the heater board 100 and pads 210 located at ends of the wires to receive electrical signals from the main apparatus. Numeral 300 denotes a top plate provided with sidewalls etc. for defining the plurality of ink channels and the common liquid chamber communicating therewith, 400 an opening for receiving ink and communicating with the common liquid chamber, and 500 an orifice plate having a plurality of discharging orifices, all of which are integrally formed for example of polysulfone. Numeral 600 denotes a supporting member for example of a metal for supporting membering the back face of the wiring substrate 200 by a flat surface thereof, which becomes a bottom plate of the ink jet unit. Numeral 700 is a stop spring for pressing and securing the top plate 300 and heater board 100 against the supporting member 600, and legs of the stop spring 700 are engaged with holes 610 of the supporting member 600. Numeral 800 is an ink supply member. The ink supply member 800 has an ink supply pipe 810 one end of which is pressed through a supply opening 1020 of ink tank IT described below against an ink absorber 1100, and an ink conduit 820 connected to the other end of the ink supply pipe 810 at one end thereof and urged against the opening for receiving ink 400 at the other end. Numeral 900 is a filter provided at the tank-side end of the ink supply pipe 810. A hole 620 through which the ink supply pipe 810 passes is formed at a position corresponding to the supply opening 1020 of supporting member 600.

The ink tank IT for supplying ink to the ink jet unit IJU as so arranged is composed of a cartridge body 1000, an ink absorber 1100 impregnated with ink, and a lid member 1200 for sealing the cartridge body 1000 after the ink absorber 1100 is put into the cartridge body 1000 from the opposite side to the mount surface of the ink jet unit IJU. The cartridge body 1000 has an air communication opening 1010 for supplying air into the ink tank IT, and a liquid repellent member 1300 for preventing ink leakage through the air communication opening 1010 is inserted into the air communication opening 1010. Also, the ink supply opening 1020 is formed in the cartridge body 1000, and a packing 1400 is set in the ink supply opening 1020. The ink jet unit IJU as described above is mounted to the cartridge body 1000 by fixing the side supporting member 600 on the opposite side to the insertion side of ink absorber 1100 in the cartridge body 1000, and is covered by a lid member 1500.

Figure 15:
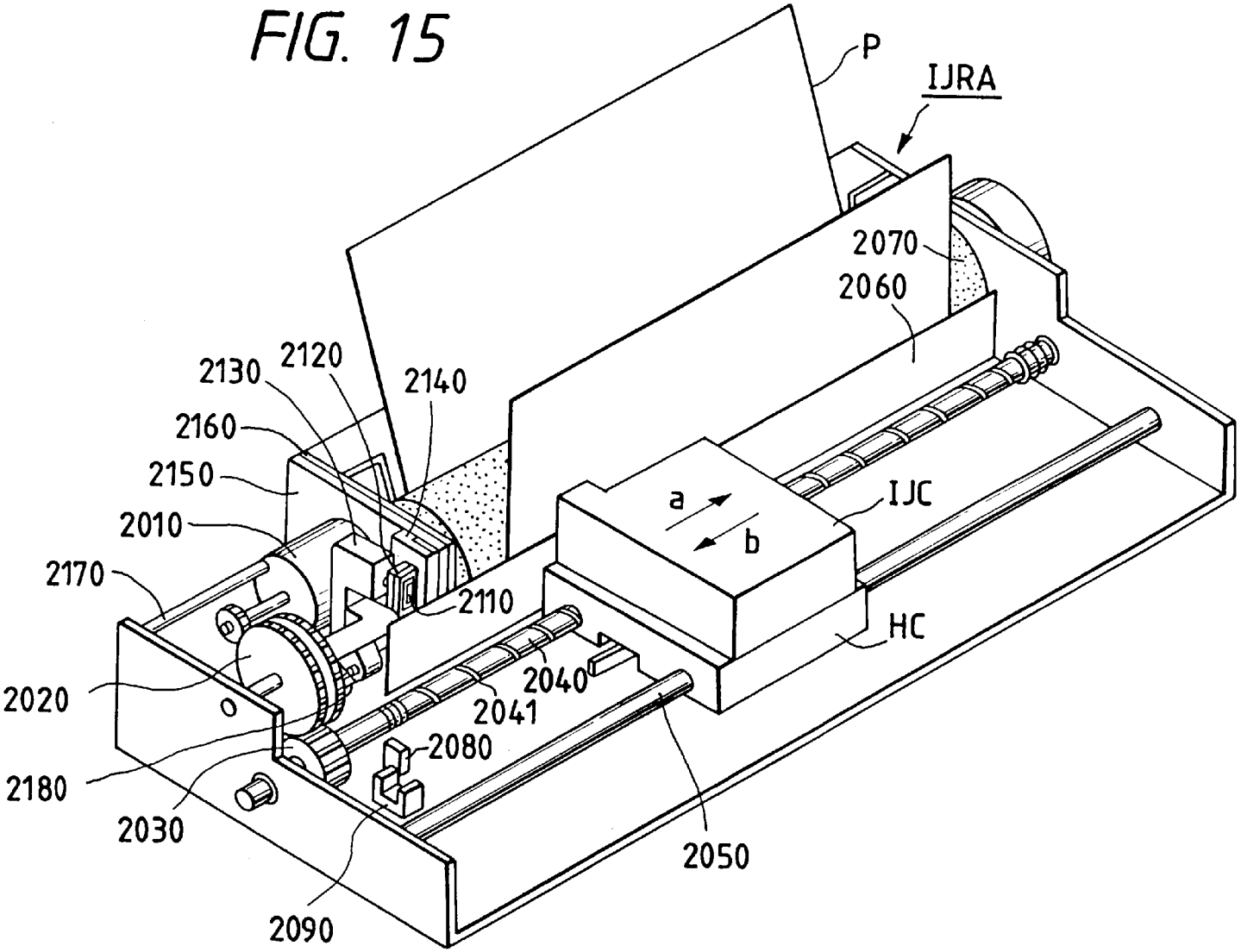
FIG. 15 is a perspective view to show an example of an ink jet recording apparatus in which the ink jet head of the present invention is mounted.

FIG. 15 is a schematic view to show an example of an ink jet recording apparatus to which the ink jet cartridge IJC having the above structure is loaded. This ink jet recording apparatus IJRA has a lead screw 2040 rotated through driving force transmission gears 2020, 2030 in synchronization with forward or backward rotation of a drive motor 2010. A carriage HC on which the ink jet cartridge IJC is mounted is supported by a carriage shaft 2050 and the lead screw 2040 and has a pin (not shown) engaged with a spiral groove 2041 on the lead screw 2040, so that it is moved back and forth in the directions of arrows a, b with rotation of the lead screw 2040. Numeral 2060 is a sheet stop plate, which presses a sheet P against a platen roller 2070 throughout the direction of carriage movement. Numerals 2080 and 2090 designate a photo coupler, which functions as home position detecting means for detecting presence of a lever 2100 provided on the carriage HC in this area and changing over the rotation direction of motor 2010. Numeral 2110 is a cap member for covering the front surface of the recording head, which is supported by a supporting member 2120. Numeral 2130 is a suction means for sucking the inside of the cap, which performs suction recovery of the recording head through an opening in the cap. A cleaning blade 2140 for cleaning the end face of the recording head is provided on a member 2150 so as to be movable back and forth, and these members are supported by a body supporting plate 2160. It is noted that the blade 2140 is not limited to this type but any known cleaning blade can be applied to this example. Further, 2170 is a lever for starting suction for the suction recovery, which is arranged to move with movement of cam 2180 engaged with the carriage HC, whereby a driving force from the drive motor 2010 is movement-controlled through known transmission means such as clutch changeover etc.

These capping, cleaning, and suction recovery are so arranged that a desired treatment can be performed at a corresponding position by an action of the lead screw 2040 when the carriage HC comes to the area on the home position side.

What is claimed is:

1. An ink jet recording head having a discharge orifice for discharging an ink, comprising:

a substrate comprising:

an insulating supporting member; and a polycrystalline silicon p-n junction diode for effecting switching for discharging the ink formed on said insulating supporting member, wherein a p-n junction surface of said polycrystalline silicon p-n junction diode extends in a direction perpendicular to a surface of said insulating supporting member.

2. An ink jet recording head according to claim 1, wherein said diode comprises a polycrystalline silicon layer and at least one metal silicide layer, said polycrystalline silicon layer having said p-n junction surface therein.

3. An ink jet head according to claim 2, wherein said metal silicide layer is a tungsten silicide layer.

4. An ink jet head according to claim 3, wherein said ink jet head has an electrothermal converter for generating thermal energy to cause film boiling in ink, as energy generating member for generating energy which is utilized for discharging ink through said discharging orifices.

5. An ink jet head according to claim 2, wherein said ink jet head has an electrothermal converter for generating thermal energy to cause film boiling in ink, as energy generating member for generating energy which is utilized for discharging ink through said discharging orifices.

6. An ink jet recording head according to claim 1, further comprising a plurality of said diodes provided on said supporting member, each said diode comprising a polycrystalline silicon layer and at least one metal silicide layer, wherein said polycrystalline silicon layer has the p-n junction surface of said diode formed therein, wherein said ink jet head is detachably mounted on a main body of a recording apparatus.

7. An ink jet recording head according to claim 1, further comprising a plurality of said diodes provided on said supporting member, each said diode comprising a polycrystalline silicon layer and at least one metal silicide layer, wherein said polycrystalline silicon layer has the p-n junction surface of said diode formed therein.

wherein said metal silicide layer is a tungsten silicide layer, and wherein said ink jet head is detachably mounted on a main body of a recording apparatus.

8. An ink jet recording head according to claim 1, further comprising a plurality of said diodes provided on said supporting member, each said diode comprising a polycrystalline silicon layer and at least one metal silicide layer, wherein said polycrystalline silicon layer has the p-n junction surface of said diode formed therein;

an electrothermal converter for generating thermal energy to cause film boiling in the ink; and an energy generating member for generating energy which effects discharge of the ink through the discharging orifices, wherein said ink jet head is detachably mounted on a main body of a recording apparatus.

9. An ink jet recording head according to claim 1, wherein said insulating supporting member is a supporting member obtained by oxidizing silicon wafer.

10. An ink jet recording head according to claim 1, wherein said insulating supporting member is a glass member.

11. An ink jet recording head according to claim 1, wherein said ink jet recording head is provided with an electrothermal converter for generating thermal energy for discharging ink.

12. An ink jet recording head according to claim 11, wherein said ink jet recording head is so arranged that ink is discharged through a discharging orifice by utilizing film boiling caused in ink by thermal energy applied by said electrothermal converter.

13. An ink jet recording head having a discharge orifice for discharging an ink, comprising:

a substrate comprising;

an insulating supporting member, and polycrystalline silicon p-n junction diode for effecting switching for discharging the ink formed on said insulating supporting member.

wherein a p-n junction surface of said polycrystalline silicon p-n junction diode is not flat.

14. An ink jet recording head having a discharge orifice for discharging an ink, comprising:

a substrate comprising:

an insulating supporting member, and a polycrystalline silicon p-n junction diode for effecting switching for discharging the ink formed on said insulating supporting member.

wherein a p-n junction surface of said polycrystalline silicon p-n junction diode is a closed surface and wherein the inside of the closed p-n junction surface has n-type polycrystalline silicon and the outside of the closed p-n junction surface has p-type polycrystalline silicon.

15. An ink jet recording head having a discharge orifice for discharging an ink, comprising:

a substrate comprising;

an insulating supporting member, and a polycrystalline silicon p-n junction diode for effecting switching for discharging the ink formed on said insulating supporting member, wherein a p-n junction surface of said polycrystalline silicon p-n junction diode is a closed surface and wherein the inside of the closed p-n junction surface has p-type polycrystalline silicon and the outside of the closed p-n junction surface has n-type polycrystalline silicon.

16. An ink jet recording head having a discharge orifice for discharging an ink, comprising:

a substrate comprising;

an insulating supporting member, and a plurality of polycrystalline silicon p-n function diodes for effecting switching for discharging the ink formed on said insulating supporting member, wherein a length of a device isolation region which is a distance in a direction perpendicular to a p-n junction surface between a first polycrystalline silicon p-n junction diode and a second polycrystalline silicon p-n junction diode is shorter than a length of said first or second polycrystalline silicon p-n junction diode in the direction perpendicular to the p-n junction surface.

17. An ink jet recording head having a discharge orifice for discharging an ink, comprising:

a substrate comprising;

an insulating supporting member, and a polycrystalline silicon p-n junction diode for effecting switching for discharging the ink formed on said insulating supporting member, wherein a thickness of polycrystalline silicon of said polycrystalline silicon p-n junction diode is in a range of 500 Å to 2000 Å.

18. An ink jet recording head having a discharge orifice for discharging an ink, comprising:

a substrate comprising;

an insulating supporting member, and a polycrystalline silicon p-n junction diode for effecting switching for discharging the ink formed on said insulating supporting member, wherein a p-n junction area of said polycrystalline p-n junction diode is in a range of $1\times10^2$ $\mu m^2$ to $1\times10^3$ $\mu m^2$.

19. An ink jet recording apparatus comprising:

an ink jet recording head having a discharge orifice for discharging an ink, comprising;

a substrate comprising;

an insulating supporting member, and a polycrystalline silicon p-n junction diode for effecting switching for discharging the ink formed on said insulating supporting member, wherein a p-n junction surface of said polycrystalline silicon p-n junction diode extends in a direction perpendicular to a surface of said insulating supporting member; and a supporting member for supporting said ink jet recording head.

20. An ink jet recording apparatus according to claim 19, wherein said ink jet head has an electrothermal converter for generating thermal energy to cause film boiling in ink, as energy generating member for generating energy which is utilized for discharging ink through said discharging orifices.

21. An ink jet recording apparatus comprising:

an ink jet recording head having a discharge orifice for discharging an ink, comprising;

a substrate comprising;

an insulating supporting member, and a polycrystalline silicon p-n junction diode for effecting switching for discharging the ink formed on said insulating supporting member, wherein a p-n junction surface of said polycrystalline silicon p-n junction diode is not flat; and a supporting member for supporting said ink jet recording head.

22. An ink jet recording apparatus according to claim 21, wherein said ink jet head has an electrothermal converter for generating thermal energy to cause film boiling in ink, as energy generating member for generating energy which is utilized for discharging ink through said discharging orifices.

23. An ink jet recording apparatus comprising:

an ink jet recording head having a discharge orifice for discharging an ink, comprising;

a substrate comprising;

an insulating supporting member, and a polycrystalline silicon p-n junction diode for effecting switching for discharging the ink formed on said insulating supporting member, wherein a p-n junction surface of said polycrystalline silicon p-n junction diode is a closed surface and wherein the inside of the closed p-n junction surface has n-type polycrystalline silicon and the outside of the closed p-n junction surface has p-type polycrystalline silicon; and a supporting member for supporting said ink jet recording head.

24. An ink jet recording apparatus according to claim 23, wherein said ink jet head has an electrothermal converter for generating thermal energy to cause film boiling in ink, as energy generating member for generating energy which is utilized for discharging ink through said discharging orifices.

25. An ink jet recording apparatus comprising:

an ink jet recording head having a discharge orifice for discharging an ink, comprising;

a substrate comprising;

an insulating supporting member, and a polycrystalline silicon p-n junction diode for effecting switching for discharging the ink formed on said insulating supporting member, wherein a p-n junction surface of said polycrystalline silicon p-n junction diode is a closed surface and wherein the inside of the closed p-n junction surface has p-type polycrystalline silicon and the outside of the closed p-n junction surface has n-type polycrystalline silicon; and a supporting member for supporting said ink jet recording head.

26. An ink jet recording apparatus according to claim 25, wherein said ink jet head has an electrothermal converter for generating thermal energy to cause film boiling in ink, as energy generating member for generating energy which is utilized for discharging ink through said discharging orifices.

27. An ink jet recording apparatus comprising:

an ink jet recording head having a discharge orifice for discharging an ink, comprising;

a substrate comprising;

an insulating supporting member, and a plurality of polycrystalline silicon p-n junction diodes for effecting switching for discharging the ink formed on said insulating supporting member, wherein a length of a device isolation region which is a distance in a direction perpendicular to a p-n junction surface between a first polycrystalline silicon p-n junction diode and a second polycrystalline silicon p-n junction diode is shorter than a length of said first or second polycrystalline silicon p-n junction diode in the direction perpendicular to the p-n junction surface; and a supporting member for supporting said ink jet recording head.

28. An ink jet recording apparatus according to claim 27, wherein said ink jet head has an electrothermal converter for generating thermal energy to cause film boiling in ink, as energy generating member for generating energy which is utilized for discharging ink through said discharging orifices.

29. An ink jet recording apparatus comprising:

an ink jet recording head having a discharge orifice for discharging an ink, comprising;

a substrate comprising;

an insulating supporting member, and a polycrystalline silicon p-n junction diode for effecting switching for discharging the ink formed on said insulating supporting member, wherein a thickness of polycrystalline silicon of said polycrystalline silicon p-n junction diode is in a range of 500 Å to 2000 Å; and a supporting member for supporting said ink jet recording head.

30. An ink jet recording apparatus according to claim 29, wherein said ink jet head has an electrothermal converter for generating thermal energy to cause film boiling in ink, as energy generating member for generating energy which is utilized for discharging ink through said discharging orifices.

31. An ink jet recording apparatus comprising:

an ink jet recording head having a discharge orifice for discharging an ink, comprising;

a substrate comprising;

an insulating supporting member, and a polycrystalline silicon p-n junction diode for effecting switching for discharging the ink formed on said insulating supporting member, wherein a p-n junction area of said polycrystalline p-n junction diode is in a range of $1\times10^2$ $\mu m^2$ to $1\times10^3$ $\mu m^2$; and a supporting member for supporting said ink jet recording head.

32. An ink jet recording apparatus according to claim 31, wherein said ink jet head has an electrothermal converter for generating thermal energy to cause film boiling in ink, as energy generating member for generating energy which is utilized for discharging ink through said discharging orifices.

* * * * *

UNITED STATES PATENT AND TRADEMARK OFFICE

CERTIFICATE OF CORRECTION

PATENT NO. : 5,975,685
DATED : November 2, 1999
INVENTOR(S) : Tetsuo Asaba et al.

It is certified that error appears in the above-identified patent and that said Letters Patent is hereby corrected as shown below:

Title page,
Item [30], Foreign Application Priority Data,
"Jun 5, 1997 [JP] Japan .....9-163262" should read
-- Dec. 28, 1993 [JP] Japan .....5-337903
Nov. 30, 1994 [JP] Japan .....6-296394 --.

Column 1,
Line 67, "*" should be deleted.

Column 4,
Line 1, "These" should read -- ¶ These --.

Column 8,
Line 27, "FIG.1C," should read -- FIG. 11C, --.

Column 11,
Line 21, "polycrystalline" should read -- a polycrystalline --; and
Line 57, "function" should read -- junction --.

Signed and Sealed this

Twelfth Day of August, 2003

JAMES E. ROGAN
*Director of the United States Patent and Trademark Office*